US006238046B1

(12) United States Patent
Donahue

(10) Patent No.: US 6,238,046 B1
(45) Date of Patent: May 29, 2001

(54) LIQUID INK PRINTER INCLUDING A VARIABLE THROUGHPUT ACTIVE-PASSIVE WET SHEET DRYER ASSEMBLY

(75) Inventor: Frederick A. Donahue, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/412,626

(22) Filed: Oct. 4, 1999

(51) Int. Cl.[7] ..... B41J 2/01
(52) U.S. Cl. ..... 347/102
(58) Field of Search ..... 347/102; 34/418, 34/419, 420, 523, 524, 184, 103; 101/416.1, 419; 271/176, 178, 187

(56) References Cited

U.S. PATENT DOCUMENTS

| | | | |
|---|---|---|---|
| 2,306,607 | 12/1942 | Horton | 34/23 |
| 4,088,314 | 5/1978 | Phillips | 271/176 |
| 4,385,756 | 5/1983 | Beery | 271/186 |
| 4,970,528 | 11/1990 | Beaufort et al. | 346/25 |
| 4,982,207 | 1/1991 | Tunmore et al. | 346/138 |

*Primary Examiner*—Huan Tran
(74) *Attorney, Agent, or Firm*—Tallam I. Nguti

(57) ABSTRACT

A variable throughput active-passive dryer assembly is provided for handling and controllably drying wet sheets printed in a liquid ink printer. The variable throughput active-passive dryer assembly includes a rotatable cylindrical member including a support shaft and an exterior surface defining a path of movement therefor; a driving device for rotatably or indexably driving the exterior surface of the rotatable cylindrical member about the path of movement; a number of wet sheet holding and releasing slots formed in the rotatable cylindrical member from the exterior surface towards a center thereof for retaining and passively allowing wet sheets to dry; an active drying component associated with each wet sheet holding and releasing slot for actively drying a wet sheets within each such slot; and a programmable controller connected to, and controlling operation of, the driving device, and of the active drying component, thereby enabling variable throughput handling and active, as well as passive, drying of wet printed sheets without ink offset and image smearing problems.

20 Claims, 5 Drawing Sheets

LIQUID INK PRINTER INCLUDING A VARIABLE THROUGHPUT ACTIVE-PASSIVE WET SHEET DRYER ASSEMBLY

BACKGROUND OF THE INVENTION

The present invention relates to liquid ink printers, and more particularly to a variable throughput active-passive dryer assembly for use in such a printer to handle wet printed sheets and stack them without ink offset and image smearing problems.

Printing in ink jet printers demands that excess moisture (generally water) on the surface of printed sheets be removed within a set time period and before the sheets are stacked. If the sheets are stacked before the images are dry, image smearing and offset occur. Devices that actively remove moisture, specifically water, from the sheet surface are referred to as dryer assemblies. A commonly used dryer assembly is a hot air convective mass transfer drying system. While dryer assemblies are effective in rapidly removing the excess moisture from the sheets, dryer assemblies greatly increase printer power requirements and size. If dryer assemblies were used in small printers, the size and cost of these printers would greatly increase. Also, most small printers do not have the power throughput to accommodate an active dyer.

The following references may be relevant as background for the present invention. U.S. Pat. No. 4,088,314 issued to Ronald Alfred Phillips, is directed to sheet handling in general, and discloses a synchronous document stacking device that includes a rotatable carrier member having spiral pockets for receiving documents at a loading position, and releasing them at an unload stacking position. Similarly, U.S. Pat. No. 4,385,756 issued to Jack Heery, is directed to sheet handling in general, and discloses a inverting and stacking apparatus that includes a rotatable carrier member having parallel arms and slots for receiving sheets at a loading position, and releasing them at an unload stacking position. The use of "Tined stacker wheels" or stacking devices of the rotating spiral carrier type as here, for inverting and or stacking sheets of paper, are well known. The present invention however incorporates and combines aspects of such a device to form a uniquely controllable mechanism for wet sheet drying in a liquid ink printer applications.

Directed to drying of wet sheets in a liquid ink printer, there is for example, U.S. Pat. No. 2,306,607 to Horton that discloses a web drying device for sheets printed by an intaglio printing apparatus. The web drying device feeds the web along a series of rollers while exposing the web to heat blown onto the web by an exhaust fan. The prior art references all teach the use of some type of active heating element to dry the freshly printed sheets. As discussed above, these active dryer assemblies demand increased printer power throughput and also increase the size and cost of the printing apparatus which is unacceptable for a small, relatively inexpensive printer.

U.S. Pat. No. 4,970,528 to Beaufort et al. discloses an ink jet printing apparatus having a uniform heat flux dryer assembly system which uses an infrared bulb and reflectors to transmit heat to the printed paper during the ink drying process. The freshly printed sheet is dried as it is fed from the printing apparatus along a 180 degree arc which surrounds the infrared bulb and reflectors.

U.S. Pat. No. 4,982,207 to Tunmore et al. discloses an ink jet printer having a rotary platen with a heater contained therein. The platen is made of a heat conducting material to transmit the heat from the heater unit enclosed therein to the outer surface of the platen to dry the printed sheet before it is fed to a stacking unit.

Thus, these small printers must rely on passive or low power drying systems to dry the wet sheets in order to maintain their low cost. However, most passive drying systems require large areas to avoid wet sheets from contacting any surface which will cause smearing and therefore, greatly increase the size of the printer. Additionally, due to the nature of some images being printed, an amount of ink deposited on some sheets is too much to be effectively dried passively before such sheet is placed on a stack.

Presently, most low end ink jet printers use fast dry ink formulations to allow low cost solutions to eliminate ink offsetting after printing. Ink offsetting is the unwanted transfer of ink from one printed page to another. These printers typically use holding stations that keep the presently printing page from contact with the previous one. Some such printers use a one sheet buffer to do this. For example, the one sheet is moved momentarily onto a set of output rails after being printed, and then it is allowed to drop onto an output stack. This approach allows the one sheet to dry undisturbed while the next sheet is being printed. However, more costly drying solutions are required when slower dry inks are used, or in higher speed higher throughput printers.

Some ink jet printers use preheating of the paper as well as high power active radiant heating in attempts to intercolor bleeding, and to aide in drying wet sheets. However, as liquid ink or ink jet printing devices become faster in speed, and require better print quality, better solutions will be required for wet sheets that move to fast to sufficiently dry before stacking, and thus usually susceptible to ink offsetting and smearing.

There is therefore a need for a low power, combination passive and active sheet handler and dryer assembly for use in liquid ink printers to effectively handle and dry wet sheets.

SUMMARY OF THE INVENTION

In accordance with the present invention, there is provided a variable throughput active-passive dryer assembly for handling and controllably drying wet sheets printed in a liquid ink printer. The variable throughput active-passive dryer assembly includes a rotatable cylindrical member including a support shaft and an exterior surface defining a path of movement therefor; a driving device for rotatably or indexably driving the exterior surface of the rotatable cylindrical member about the path of movement; a number of wet sheet holding and releasing slots formed in the rotatable cylindrical member from the exterior surface towards a center thereof for retaining and passively allowing wet sheets to dry; an active drying component associated with each wet sheet holding and releasing slot for actively drying a wet sheets within each such slot; and a programmable controller connected to, and controlling operation of, the driving device, and of the active drying component, thereby enabling variable throughput handling and active, as well as passive, drying of wet printed sheets without ink offset and image smearing problems.

BRIEF DESCRIPTION OF THE DRAWINGS

In the detailed description of the invention presented below, reference is made to the drawings, in which.

DETAILED DESCRIPTION OF THE INVENTION

Figure 1:
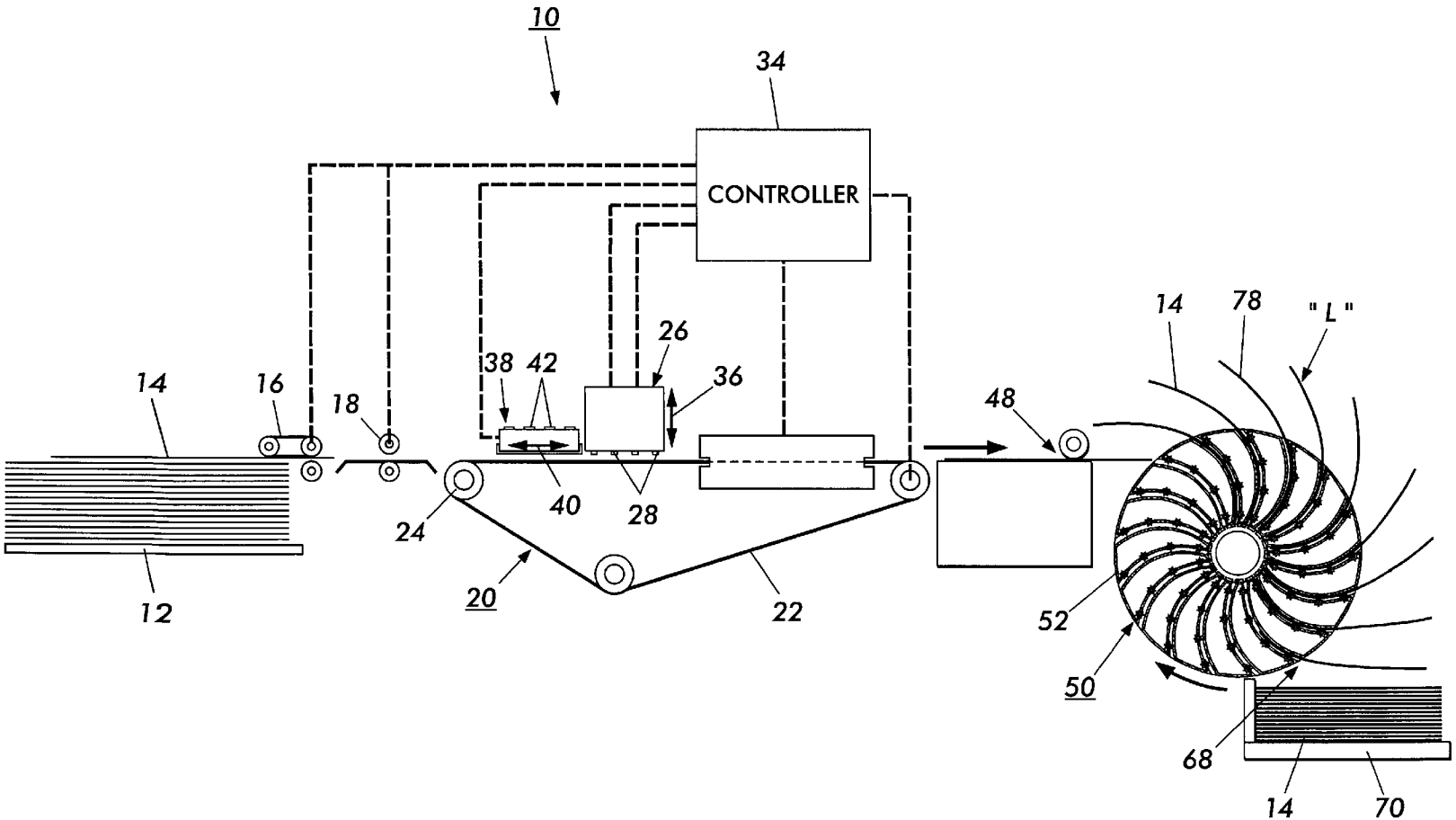
FIG. 1 is a schematic illustration of a liquid ink printer including the variable throughput active-passive wet sheet dryer assembly of the present invention.
Figure 2:
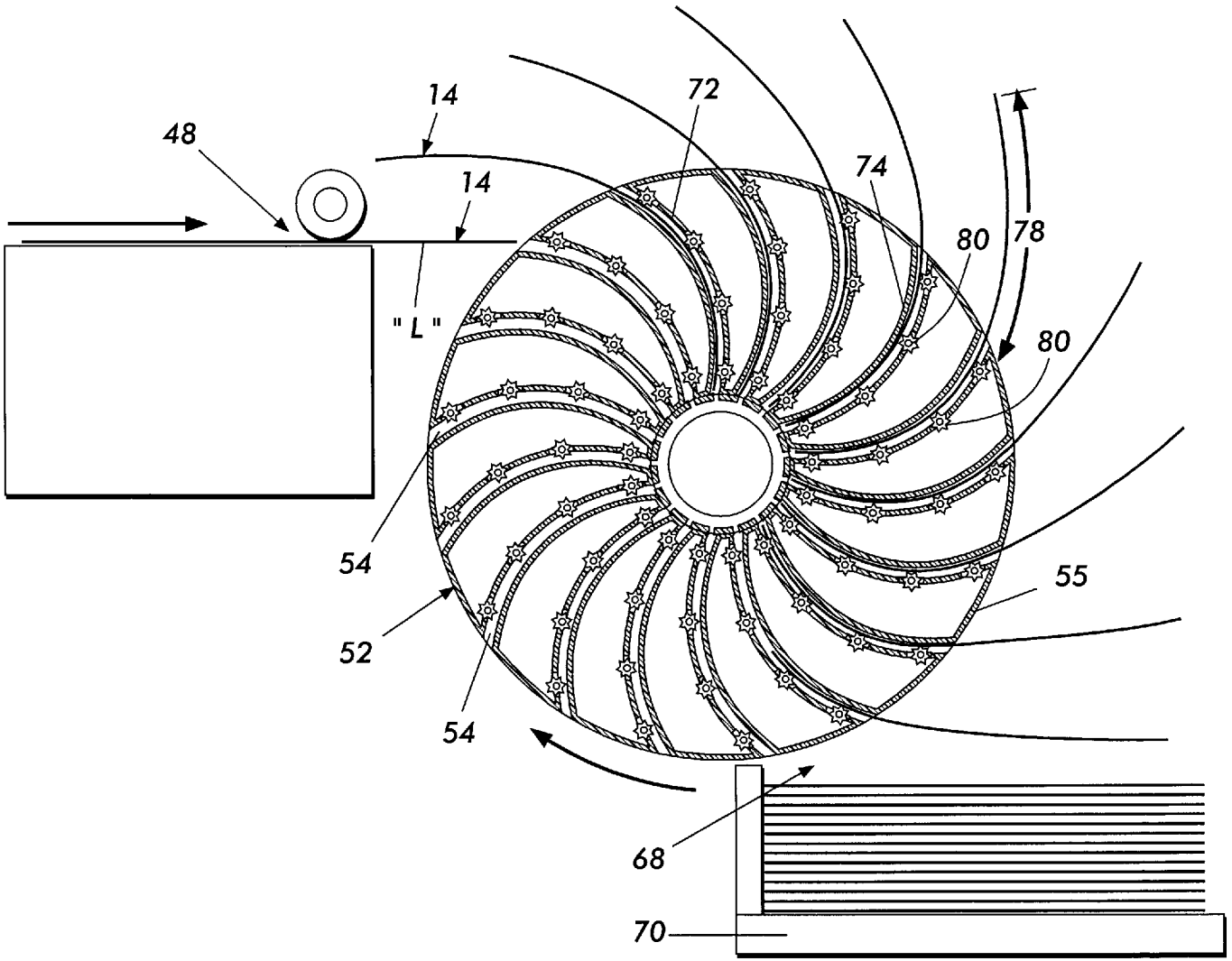
FIG. 2 is a schematic of the variable throughput active-passive wet sheet dryer assembly of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Although the present invention discussed herein may be used for drying any image which is created by a liquid ink printer, the description of the present invention will be described in the environment of an ink jet printer such as that shown in the drawings.

FIG. 1 illustrates a schematic elevational view of a liquid ink printer 10, for instance, an ink jet printer, of the present invention. The liquid ink printer 10 includes an input tray 12 containing sheets of a recording medium 14 to be printed upon by the printer 10. Single sheets of the recording medium 14 are removed from the input tray 12 by a pickup device 16 and fed by feed rollers 18 to a transport mechanism 20. The transport mechanism 20 moves the sheet by a feed belt or belts 22 driven by rollers 24 beneath a liquid ink printbar assembly 26.

The printbar assembly 26 includes one or more pagewidth printbars 28 supported in a printing position by a printhead support (not shown) in a confronting relation with the belt 22. During printing, the pagewidth printbars 28 deposit liquid ink on the recording medium 14 as it is carried by the belt 22 beneath the plurality of printbars 28. Each of the pagewidth printbars 28 includes an array of print nozzles, for instance, staggered or linear arrays, having a length sufficient to deposit ink in a printzone across the width of the recording medium 14. The present invention is equally applicable, however, to printers having partial width array ink jet printheads. The printbar assembly 26 also includes an ink supply either attached to the printhead support or coupled to the pagewidth printheads through appropriate supply tubing.

The recording medium 14 is then carried by the belt 22 to a loading station 48 where it is loaded into the variable throughput active-passive dryer assembly 50 of the present invention (to be described in detail below). From the active-passive dryer assembly 50, the recording medium or sheet 14 is unloaded into an output tray 70. A controller 34 controls the operation of the transport mechanism 20, which includes the pickup device 16, the feed roller 18 and the drive roller 24. In addition, the controller 34 controls the movement of the printbar assembly 26, printing by the printbars 28, and operation of the pactive-passive dryer assembly 50. The controller 34 can also include a plurality of individual controllers, such as microprocessors or other known devices dedicated to perform a particular function.

At the completion of a printing operation or when otherwise necessary, such as during a power failure, the printbar assembly 26, which is movable in the directions of an arrow 36, is moved away from the belt 22 such that a capping assembly 38, movable in the directions of the arrow 40, is moved beneath the printbar assembly 26 for capping thereof. Once the cap assembly 38 is positioned directly beneath the printbar assembly 26, the printbar assembly 26 is moved towards the belt 22 and into contact with a plurality of capping gaskets 42 located on the cap assembly 38.

The cap assembly 38 includes one or more of the capping gaskets 42 which engage or contact the page width printbars on an area surrounding one or more of the printbars to thereby seal the printbar nozzles from exposure to air. Suitable capping elements include those described later herein or those which compress to make a satisfactory seal. This substantially airtight seal prevents the ink contained in the nozzles from drying out to thereby prevent clogging of the individual printbar nozzles. Once a capping operation is complete, the printbar assembly 26 moves away from the belt 22 and the cap assembly 38 moves away from the printbar assembly 26 such that the printbar assembly 26 can be positioned appropriately with respect to the belt 22 for printing on the recording sheets 14.

Referring now to FIGS. 1–5, the variable throughput active-passive dryer assembly 50 as illustrated includes a rotatable cylindrical member 52 having a plurality or number of sheet retaining slots into which printed (wet) sheets are inserted and held until sufficiently dry so that ink offsetting can be eliminated. The cylindrical member 52 is incrementally rotated from a load position 48, through an active-passive drying path, and to an unload position 68 as more sheets are being printed. The cylindrical member 52 includes a supporting shaft 56 that preferably is hollow with its wall 57 having fluted slots 58 along its length. Forced air flow created for example by a forced air moving device such as a blower 62 (either ambient or heated by a heater 64) is selectively usable to actively assist in the drying process. The programmable controller 34 is connected to the heater 64 and blower 62 so it can controllably turn the active drying means (blower and heater) off depending on operating conditions and requirements of a print job being run. In operation, after each sheet is printed, it is loaded at the loading position 48 into one of the plurality of sheet-accepting slots 54. The cylindrical member 52 is then indexed by a controllable drive means such as a stepper motor 60 (controlled by controller 34) to the next slot 54 for receiving or accepting the next printed sheet.

The next slot 54 for accepting such next sheet is preferably an immediately adjacent slot in consecutive slot loading, but under the controller 34, it can be a slot once or twice removed from the previously loaded slot in what can be referred to as "skipped slot" loading. Thus, relative to the sheet loading point 48, the programmable controller 34 can controllably index the rotatable cylindrical member 52 for sheet loading into consecutive slots 54. Alternatively, the programmable controller can controllably index the rotatable cylindrical member 52 for skipped slot operation wherein sheets are loaded into non-consecutive slots 54. At a given speed, consecutive slot loading as such results in longer drying time and a higher throughput (i.e. a number of sheets held and dried per revolution of the cylindrical member 52). As such, consecutive slot loading is suitable for large jobs as well as for heavy or relatively high density print jobs. Thus for a particular job, the actual number of slots 54 being used per revolution of the cylindrical member 52 is determined by the amount of drying time needed for a particular ink and paper combination.

In either case, this process continues until all sheets in a particular job are printed, loaded and indexably moved, dried and unloaded. For large jobs having more sheets than there are slots 54 in the cylindrical member 52, sheets are simultaneously being unloaded at the unload station as they are also being loaded at the loading station or position 48. Such manner, thus allowing the maximum dry time for each sheet. When the printing is complete, the drying wheel (with its remaining FIFO of wet sheets) continues to index based on time.

As further illustrated, the variable throughput active-passive dryer assembly 50 is suitable for handling and controllably drying wet sheets printed in a liquid ink printer. As shown, it comprises a rotatable cylindrical member 52 including a support shaft 56 and an exterior surface 55 defining a path of movement therefor; indexing drive such as a stepper motor 60 for rotatably or indexably driving the exterior surface of the rotatable cylindrical member 52 about the path of movement; a number of wet sheet holding and releasing slots 54 formed in the rotatable cylindrical member 52 from the exterior surface 55 towards a center of the rotatable cylindrical member 52 for retaining and passively allowing wet sheets to dry.

Figure 4:
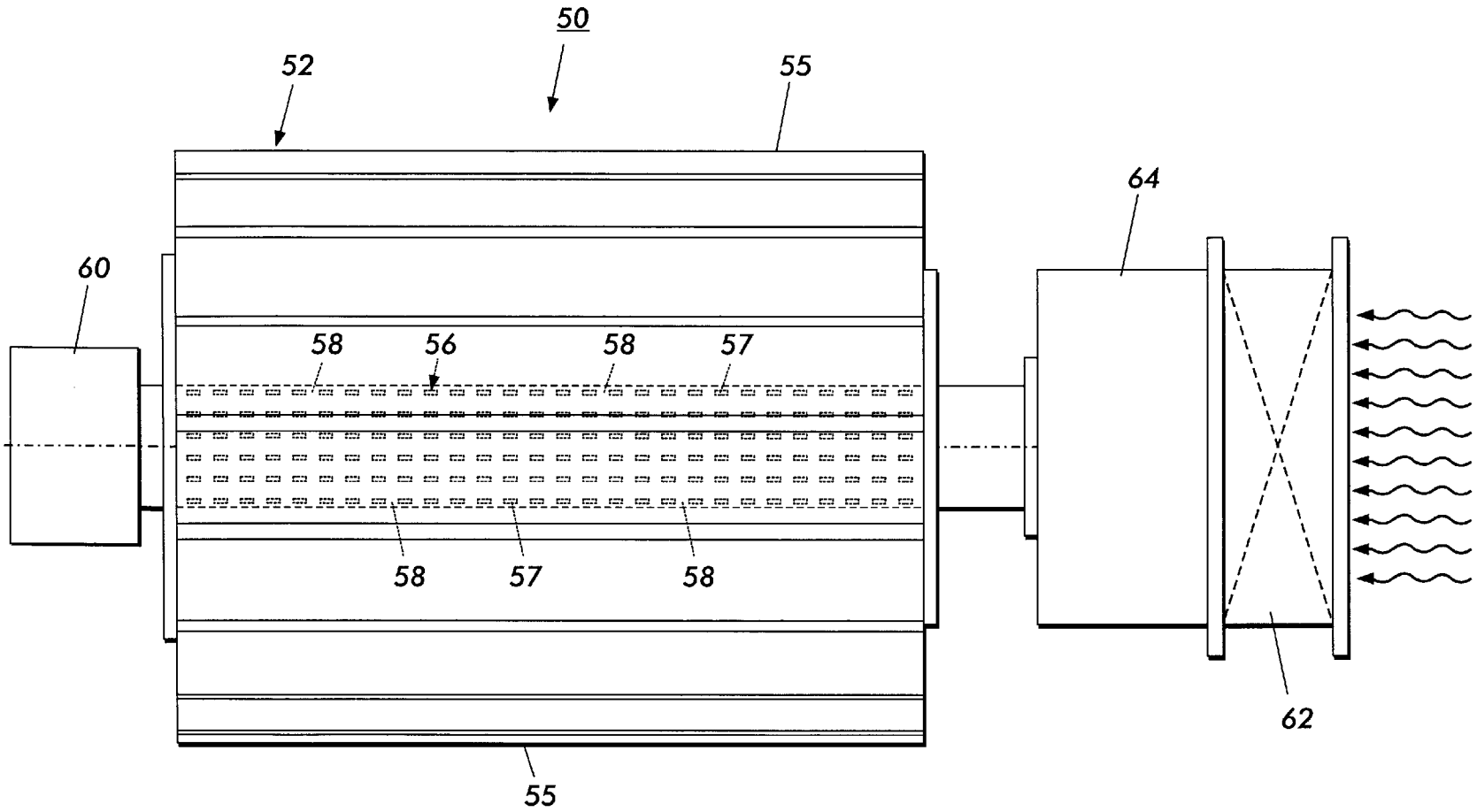
FIG. 4 is a side schematic of the variable throughput active-passive dryer assembly of the present invention.
Figure 5:
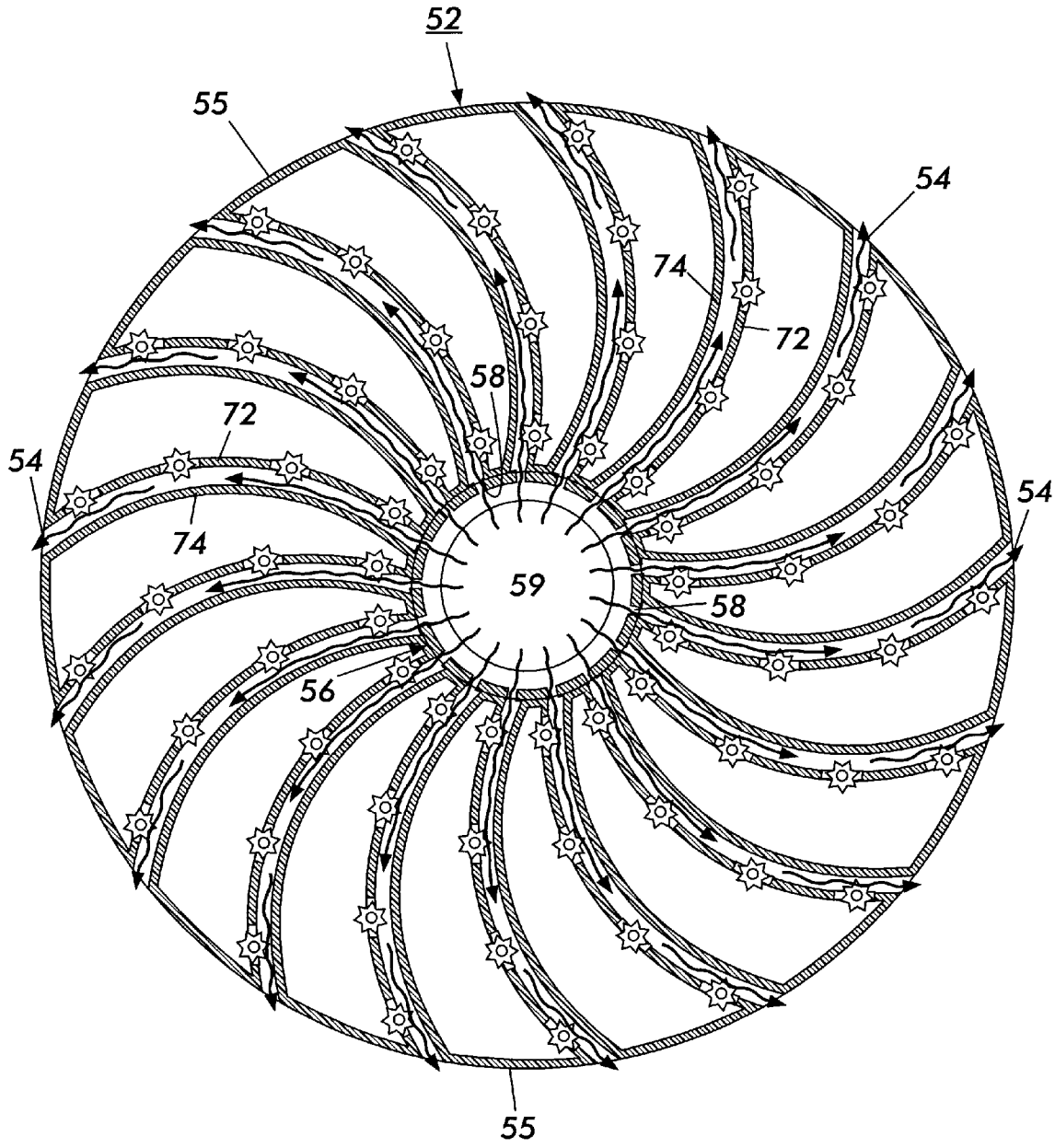
FIG. 5 is an enlarged illustration of the support shaft and forced air moving system of the variable throughput active-passive dryer assembly in accordance with the present invention.

The rotatable cylindrical member 52 also includes active drying means comprising forced air for example, being moved by the blower 62. As shown particularly in FIG. 5, the active drying means or forced air is associated with each slot 54, and is effective for actively drying a wet sheets within each slot. The, programmable controller 34 is connected to, and controls operation of, the indexing stepper motor 60, and the active drying means 62, thereby enabling variable throughput handling and active, as well as, passive drying of the wet printed sheets without ink offset and image smearing problems. As illustrated in FIGS. 4 and 5, the support shaft 56 includes a wall 57 defining a hollow interior 59, and having fluted slots 58 formed through the wall 57 for forced air flow from the hollow 59 into each slot 54. Each slot 54 terminates on the wall 57 of the support shaft 56, and over a number of the fluted slots 58.

Figure 3:
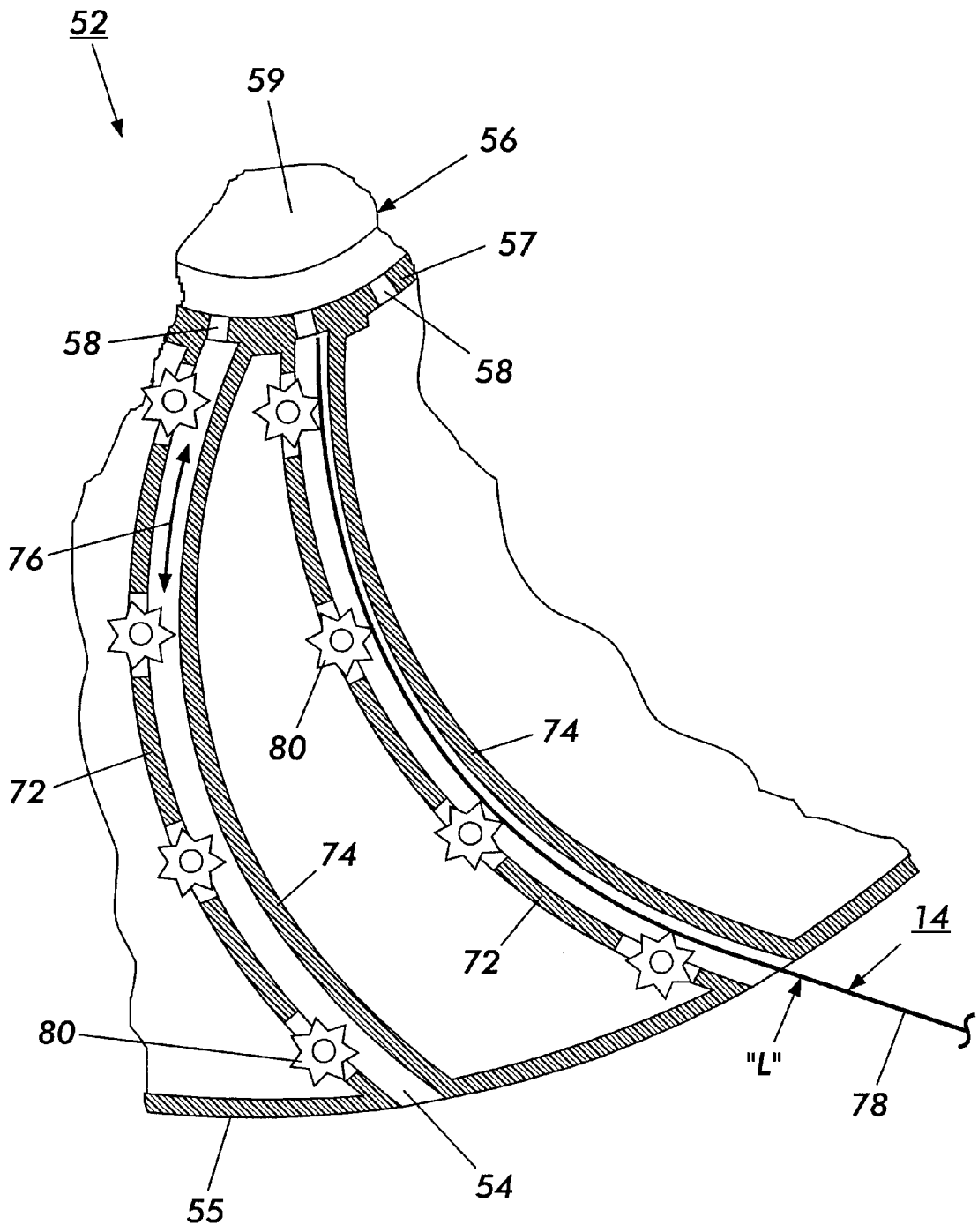
FIG. 3 is an enlarged illustration of a portion of the variable throughput active-passive wet sheet dryer assembly showing a sheet containing slot with freely rotatable star wheels.

As shown clearly in FIG. 3, each wet sheet holding and releasing slot 54 includes a concave wall 72 and a convex wall 74 that define such each wet sheet holding and releasing slot 54, and that facilitate sheet loading and sheet releasing from the slot. For holding and releasing such sheets as they are being moved along a track, and have a given in-track dimension L, each slot 54 has a depth 76 that is less than the in-track dimension of such sheets, therefore causing a significant portion 78 of the in-track dimension L of each such sheet (as shown) to overhang the exterior surface 55 of the rotatable cylindrical member 52. The concave wall 72 of each wet sheet holding and releasing slot 54 advantageously includes a number of freely rotatable star wheels 80 for spacing a wet liquid ink image side of each sheet from the concave wall 72.

As can be seen, there has been provided a variable throughput active-passive dryer assembly for handling and controllably drying wet sheets printed in a liquid ink printer. The variable throughput active-passive dryer assembly includes a rotatable cylindrical member including a support shaft and an exterior surface defining a path of movement therefor; a driving device for rotatably or indexably driving the exterior surface of the rotatable cylindrical member about the path of movement; a number of wet sheet holding and releasing slots formed in the rotatable cylindrical member from the exterior surface towards a center thereof for retaining and passively allowing wet sheets to dry; an active drying component associated with each wet sheet holding and releasing slot for actively drying a wet sheets within each such slot; and a programmable controller connected to, and controlling operation of, the driving device, and of the active drying component, thereby enabling variable throughput handling and active, as well as passive, drying of wet printed sheets without ink offset and image smearing problems.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A variable throughput active-passive dryer assembly for handling and controllably drying wet sheets printed in a liquid ink printer, the variable throughput active-passive dryer assembly comprising:

(a) a rotatable cylindrical member including a support shaft and an exterior surface defining a path of movement therefor;

(b) driving means for rotatably or indexably driving said exterior surface of said rotatable cylindrical member about said path of movement;

(c) a number of wet sheet holding and releasing slots formed in said rotatable cylindrical member from said exterior surface towards a center of said rotatable cylindrical member for retaining and passively allowing wet sheets to dry;

(d) active drying means associated with each slot of said number of slots for actively drying wet sheets within said each slot; and (e) a programmable controller connected to, and controlling operation of, said indexing means and said active drying means, thereby enabling variable throughput handling and active as well as passive drying of wet printed sheets without ink offset and image smearing problems.

2. The variable throughput active-passive dryer assembly of claim 1, wherein said support shaft includes a wall defining a hollow interior, and fluted slots formed through said wall.

3. The variable throughput active-passive dryer assembly of claim 1, wherein each wet sheet holding and releasing slot of said number of wet sheet holding and releasing slots includes a concave wall and a convex wall defining said each wet sheet holding and releasing slot so as to facilitate sheet loading and sheet releasing.

4. The variable throughput active-passive dryer assembly of claim 1, wherein for holding and releasing sheets traveling along a track and having a given in-track dimension, each wet sheet holding and releasing slot of said number of wet sheet holding and releasing slots has a depth less than the in-track dimension of such sheets so as to cause a significant portion of the in-track dimension of each such sheet to over hang said exterior surface of said rotatable cylindrical member.

5. The variable throughput active-passive dryer assembly of claim 1, wherein said active drying means comprises a forced air moving device.

6. The variable throughput active-passive dryer assembly of claim 1, wherein said programmable controller can controllably turn said active drying means off depending on operating conditions of a liquid printer.

7. The variable throughput active-passive dryer assembly of claim 1, wherein relative to a sheet loading point in a printer, said driving means can controllably rotate said rotatable cylindrical member for sheet loading into consecutive slots.

8. The variable throughput active-passive dryer assembly of claim 1, wherein relative to a sheet loading point in a printer, said driving means can controllably rotate said rotatable cylindrical member for skipped slot operation wherein sheets are loaded into non-consecutive slots.

9. The variable throughput active-passive dryer assembly of claim 1, wherein said driving means comprises a stepper motor.

10. The variable throughput active-passive dryer assembly of claim 2, wherein each wet sheet holding and releasing slot of said number of wet sheet holding and releasing slots terminates on said wall of said support shaft, and over a number of said fluted slots.

11. The variable throughput active-passive dryer assembly of claim 3, wherein said concave wall of each wet sheet holding and releasing slot of said number of wet sheet holding and releasing slots includes a number of freely rotatable star wheels for spacing a wet liquid ink image side of each sheet from said concave wall.

12. The variable throughput active-passive dryer assembly of claim 5, including a heater for actively heating said forced air.

13. A liquid ink printer comprising:

(a) an ink jet printhead including liquid ink for forming wet ink images on sheets;

(b) sheet feeding means for feeding a sheet past ink jet printhead to create wet ink images thereon;

(c) a sheet stacking tray located downstream of said ink jet printhead relative to a direction of movement of wet printed sheets; and (d) a variable throughput active-passive dryer assembly for handling and controllably drying wet sheets printed in a liquid ink printer, the variable throughput active-passive dryer assembly comprising:

(i) a rotatable cylindrical member including a support shaft and an exterior surface defining a path of movement therefor;

(ii) indexing means for rotatably driving said exterior surface of said rotatable cylindrical member about said path of movement;

(iii) a number of wet sheet holding and releasing slots formed in said rotatable cylindrical member from said exterior surface towards a center thereof for retaining and passively allowing wet sheets to dry;

(iv) active drying means associated with each slot of said number of slots for actively drying wet sheets within said each slot; and (v) a programmable controller connected to, and controlling operation of, said indexing means and said active drying means, thereby enabling variable throughput handling and active as well as passive drying of wet printed sheets without ink offset and image smearing problems.

14. The liquid ink printer of claim 13, wherein said support shaft includes a wall defining a hollow interior, and fluted slots formed through said wall.

15. The liquid ink printer of claim 13, wherein each wet sheet holding and releasing slot of said number of wet sheet holding and releasing slots includes a concave wall and a convex wall defining said each wet sheet holding and releasing slot so as to facilitate sheet loading and sheet releasing.

16. The liquid ink printer of claim 13, wherein for holding and releasing sheets traveling along a track and having a given in-track dimension, each wet sheet holding and releasing slot of said number of wet sheet holding and releasing slots has a depth less than the in-track dimension of such sheets so as to cause a significant portion of the in-track dimension of each such sheet to over hang said exterior surface of said rotatable cylindrical member.

17. The liquid ink printer of claim 13, wherein said active drying means comprises a forced air moving device.

18. The liquid ink printer of claim 13, wherein said programmable controller can controllably turn said active drying means off depending on operating conditions of a liquid printer.

19. The liquid ink printer of claim 13, wherein relative to a sheet loading point in a printer, said programmable controller can controllably index said rotatable cylindrical member for sheet loading into consecutive slots.

20. The liquid ink printer of claim 13, wherein relative to a sheet loading point in a printer, said programmable controller can controllably index said rotatable cylindrical member for skipped slot operation wherein sheets are loaded into non-consecutive slots.

* * * * *